US005667649A

United States Patent [19]

Bushman

[11] Patent Number: 5,667,649

[45] Date of Patent: Sep. 16, 1997

[54] CORROSION-RESISTANT FERROUS ALLOYS FOR USE AS IMPRESSED CURRENT ANODES

[76] Inventor: James B. Bushman, 6395 Kennard Rd., Medina, Ohio 44256

[21] Appl. No.: 496,626

[22] Filed: Jun. 29, 1995

[51] Int. Cl.[6] ..... C25B 11/00

[52] U.S. Cl. ..... 204/290 R; 204/293; 204/196; 205/731; 205/735; 205/737; 205/741; 429/40; 429/221

[58] Field of Search ..... 204/290 R, 293, 204/196; 205/731, 735, 737, 741; 429/40, 221

[56] References Cited

U.S. PATENT DOCUMENTS

| | | | |
|---|---|---|---|
| 4,448,856 | 5/1984 | Zuckerbrod | 429/27 |
| 5,062,934 | 11/1991 | Mussinellil | 204/290 R |
| 5,531,875 | 7/1996 | Shimamune et al. | 204/290 R |

*Primary Examiner*—Bruce F. Bell

*Attorney, Agent, or Firm*—Fay, Sharpe, Beall, Fagan, Minnich & McKee

[57] ABSTRACT

Impressed current anodes such as cathodic protection anodes comprise iron based alloys including less than 70% iron and less than 0.1% carbon. Additional components may include molybdenum, chromium, nickel and others. The iron based alloy may itself comprises the anode or it may provide a substrate to which an electrolytic coating is applied.

31 Claims, 1 Drawing Sheet

CORROSION-RESISTANT FERROUS ALLOYS FOR USE AS IMPRESSED CURRENT ANODES

BACKGROUND OF THE INVENTION

Over the past many years, a number of different metal based anode materials have been developed for use in the application of impressed current cathodic protection. The metals used either developed their inherent corrosion resistant surface or required the adding of a catalytic surface to facilitate the anode reaction while precluding significant consumption of the substrate metal material.

Of the self protecting metals used as anodes in cathodic protection, the most common were developed by the Duriron Company of Dayton, Ohio more than 30 years ago. These were called Duriron and the later developed Durichlor 51 alloys. Both of these materials are in the cast iron family having iron contents in excess of 75% by weight and a high carbon content of about 0.95%. Their alloy additives include silicon (approx. 14.5% by weight) with small amounts of manganese (0.75%), and chromium (only for the Durichlor 51 alloy at approx. 4.5%). While these materials have performed well for many years, they are heavy, cannot be readily machined or welded, are very brittle and still have unacceptably high anodic corrosion rates for many cathodic protection applications (typically 0.25 pounds per ampere year to more than 1 pound per ampere year depending on the anodic current density and electrolyte surrounding the anode). The only other commonly used ferrous based anode material is the magnetite anode made from a naturally occurring iron ore. This material has natural magnetic properties and is primarily a blend of ferrous and ferric oxides cast in tubular shapes ($Fe_2O_3$ and $Fe_3O_4$). Again, the iron content of this anode material is in excess of 75% by weight.

Other self protecting anode metal alloys used in cathodic protection include lead alloyed with either small additions of silver or antimony or a combination of both. Again, the base lead metal is greater than 90% by weight. These metals have worked well as cathodic protection anodes in highly saline environments such as sea water exhibiting consumption rates of a few ounces to a pound or more per ampere of current discharged continuously over a year period (consumption rate is usually expressed in grams, ounces or pounds/ampere year e.g. 1.0 pounds per ampere year). Unfortunately the alloy does not work well in brackish or fresh waters or in most underground environments which precludes its use to provide cathodic protection for structures other than those installed in or very near sea water. Both the high rate of consumption and the possibility of environmental contamination by the lead prevent its use in many otherwise desirable sea water applications.

A different kind of anode material used in cathodic protection utilizes a self passivating valve metal substrate (U.S. Pat. No. 5,062,934, Claim 1) provided with an electrocatalytic surface. The valve metal substrate is usually titanium although aluminum, zirconium, niobium (columbium) and tantalum have also been occasionally used or suggested for such use. The substrate surfaces are coated with either a precious metal or precious metal oxide both of which are typically in the platinum family of metals. Platinum has a low dissolution rate, on the order of a few micrograms per ampere year. The substrate metal serves as the anodic current carrier while virtually all current is transferred between the anode and the surrounding electrolyte only at surfaces where the coating is intact. If the coating is scraped off and the substrate is exposed to the environment, the substrate will passivate or form an oxide film, thus directing the current to flow where the platinum is located. If the substrate did not have this passivating film forming characteristic, the substrate would quickly fail as a result of high faradaic consumption rates (e.g. aluminum has a faradaic consumption rate of 6.0 pounds per ampere year). Use of platinum oxides rather than platinum is popular in the chloroalkali industry.

Unfortunately, the applicable coatings required to produce the capability of anodic current discharge while having extremely low consumption rates include only the platinum metal and metal oxide families, all of which are very expensive and must be applied under expensive and controlled conditions. For the sake of economy, the platinum or platinum oxide is applied thinly. The most commonly used applicable substrate metal is titanium which also bears a relatively high cost of \$10–\$15 per pound. On the other hand, the substrate material is available in a number of standard shapes and sizes including meshes, rods, tubes, sheets, etc. It is relatively easily machined and welded and can readily be fabricated into a number of shapes.

Some stainless steel has been suggested for use as an anode material. Unfortunately, all such materials tested in the past for their applicable use as cathodic protection anode materials have exhibited unacceptably high consumption (dissolution) rates. The typical cathodic protection electrolytes tested have also suffered from selective pitting and crevice corrosion attack. It is the inventor's observation that this is typically due to oxygen starvation attack of the metal primarily at pits and crevices which naturally and unavoidably occur in the use of these metals as anodes in cathodic protection applications.

It would be desirable to develop a cathodic protection anode comprised of a corrosion resistant ferrous alloy which resists pitting and corrosion while at the same time provides desirable results in an economical fashion.

BRIEF DESCRIPTION OF THE INVENTION

The present invention is directed to impressed current anodes such as cathodic protection anodes which are comprised of iron based alloys including less than 70% iron and less than 0.1% carbon. The alloy may comprise additional components including chromium, nickel, molybdenum, and trace amounts of other components. These high alloy or superalloy stainless steels have not before been considered for use as impressed current anode materials, particularly in view of the pitting and corrosion evidenced in usage of lower level stainless steels—such as 304 and 316 stainless steels. The iron based alloy may itself comprise the anode or it may be a substrate to which an electrolytic coating is applied.

An advantage of the present invention is that the superalloy stainless steels used in forming the anodes are less expensive than the valve metals used in prior art anode materials. The anode materials used herein may range from about \$5–\$10 per pound while valve metals such as titanium are in the range of about \$12–\$15 per pound. This does not take into account the cost of coating the valve metal with expensive precious metals. Moreover, the anode materials used in the present invention are equally effective as compared to prior art anodes.

Another advantage of the present invention is that the materials used in formation of the impressed current anodes discussed herein are superalloy stainless steels which are resistant to corrosion and pitting. This is in contrast to lower level stainless 304 and 316 stainless steels which pit and corrode readily. The superalloys are higher in alloy content than ordinary stainless steels.

Other advantages will become apparent to those skilled in the art upon a reading of the detailed description below.

BRIEF DESCRIPTION OF THE DRAWINGS

The figures merely serve to illustrate some of the configurations in which the anodes of the present invention may be made, and are not intended to be limiting in any way.

DETAILED DESCRIPTION OF THE PREFERRED EMBODIMENT

The inventor has recently investigated the availability of more highly corrosion resistant ferrous metal alloys and, in particular, their suitability for use as anodes, particularly cathodic protection anodes. These new alloys include the addition to iron of more than 18% chromium and more than 2% molybdenum and 10% nickel to provide enhanced crevice and pitting corrosion attack resistance. They all have low concentrations of carbon (less than 0.1% by weight) and have good ductility and machinability. They are also weldable. The inventor has found that a number of these alloys exhibit favorable performance characteristics when initially tested as cathodic protection anode candidate materials in potable water, sea water and concrete pore water electrolytes. Consumption rates at typical cathodic protection current densities in typical application environments have been very low compared to other ferrous alloys previously tested with lower alloy contents. All of the alloys tested have, in common, iron contents of less than 70% by weight and are very resistant to both pitting and crevice corrosion attack relative to ASTM 316 and ASTM 304 stainless steels.

Examples of alloys which may be used in preparing the impressed current anodes of the present invention include, but are not limited to, 654 SMO available from Avesta Sheffield of Avesta, Sweden, and AL-6XN alloy available from Allegheny Ludlum Corporation of Pittsburgh, Pa.

Avesta Sheffield 654 SMO, ASTM S32654, is an austenitic stainless steel. It has a high content of molybdenum, nitrogen and chromium and, as a result, resists pitting and crevice corrosion. The typical chemical composition of this alloy is as follows:

| COMPONENT | WEIGHT PERCENT |
|---|---|
| Carbon | 0.01 |
| Chromium | 24 |
| Nickel | 22 |
| Molybdenum | 7.3 |
| Nitrogen | 0.5 |
| Iron | 46% |
| Copper | Trace |
| Manganese | Trace |

The AL-6XN alloy is also an austenite stainless steel having a higher molybdenum, nickel and chromium content than standard type 304, 316 and 317 stainless steel grades. The typical chemical composition of the AL-6XN alloy is as follows:

| COMPONENT | WEIGHT PERCENT |
|---|---|
| Carbon | 0.02 |
| Manganese | 0.40 |
| Phosphorus | 0.025 |
| Sulfur | 0.002 |
| silicon | 0.40 |
| Chromium | 20.5 |
| Nickel | 24.0 |
| Molybdenum | 6.3 |
| Nitrogen | 0.22 |
| Copper | 0.1 |
| Iron | Balance |

These and similar types of superalloys may be used either directly as the impressed current cathodic protection anode material or they may be used as the substrate on which performance enhancing coatings including electro-catalytic coatings such as precious metals or precious metal oxides and conductive ceramic coatings are applied, the combination of which is used as the impressed current cathodic protection anode material.

Figure 1:
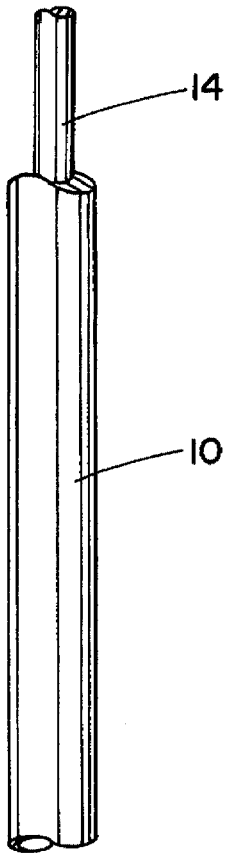
FIG. 1 discloses a tubular anode comprised of the materials of the present invention.
Figure 2:
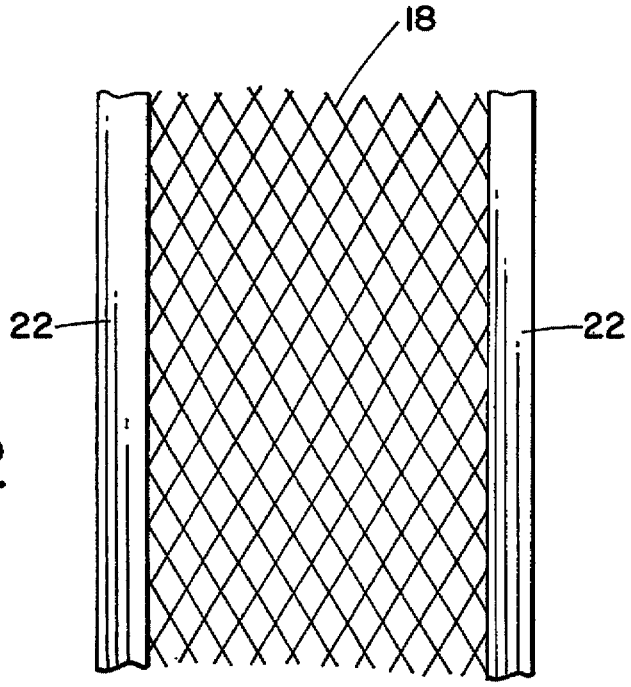
FIG. 2 is an example of one type of mesh grid anode configuration comprised of the materials described in this invention.

These alloys can be fabricated into many different shapes for use as anode materials depending on the application for which cathodic protection is used including tubes, rods, sheets, meshes, strips and any combination of these forms. FIGS. 1 and 2 are provided merely as examples of the various configurations in which the anodes of the present invention may be formed. The figures are by no means intended to be limiting, as the anodes may take on a variety of configurations. FIG. 1 shows a tubular anode 10 with a cable or wire 14 extending therefrom. FIG. 2 discloses one type of mesh arrangement. The mesh portion 18 is primarily open and longitudinal strips 22 are shown on each side.

The alloys and anodes described herein are useful in a variety of applications extending beyond cathodic protection. For example, some of the other applications include, but are not limited to, electrowinning of metal; extraction of ions from sea water and fresh water electrolytes; as well as other electrochemical processes where an anode material is required. Of course, there is no single universal anode for every single possible application, and testing should be conducted to optimize an anode's applicability to given environments.

EXAMPLES

Examples of the alloys which the inventor claims as unique when used as anode materials include:

1. All iron alloys having less than 0.1% by weight carbon with chromium contents in excess of 20%.
2. All iron alloys having less than 0.1% by weight carbon with nickel contents in excess of 20%.
3. All iron alloys having less than 0.1% by weight carbon with molybdenum contents in excess of 5%.
4. All iron alloys having less than 0.1% by weight carbon with chromium contents in excess of 20% and nickel contents greater than 10%.
5. All iron alloys having less than 0.1% by weight carbon with chromium contents in excess of 20% and Molybdenum contents in excess of 5%.
6. All iron alloys having less than 0.1% by weight carbon with nickel contents in excess of 20% and molybdenum contents in excess of 5%.
7. All iron alloys having less than 0.1% by weight carbon with nickel contents in excess of 20% and chromium contents in excess of 20% and molybdenum contents in excess of 5%.

Nitrogen may be added to any of the above alloys to increase the alloy tensile strength and corrosion resistance. The above compositions are useful alloys for anodes used in a variety of applications and environments. They may most readily be used in producing a cathodic protection system anode material to protect metal structures against corrosion in the common electrolytes in which these structures are either immersed, buried or submerged.

The following table identifies the compositions of selected superalloy materials which were tested specifically for use as cathodic protection anodes:

| Fe (%) | Cr (%) | Ni (%) | Mo (%) | C (%) | Ni (%) | Cu (%) | Mn (%) |
|---|---|---|---|---|---|---|---|
| <46.69 | 24% | 22% | 7.3 | .01 | Trace | Trace | Trace |
| 48.46 | 20.5 | 24 | 6.3 | .02 | .22 | 0.1 | 0.4 |
| <55.69 | 20 | 18 | 6.1 | .01 | .2 | Trace | Trace |

The above compositions were tested and anode materials in concrete pour water (i.e. calcium hydroxide solution), potable water, and sea water and favorable results occurred. The tests showed that the above materials are at least equally effective compared to prior art anode materials which are significantly more expensive. The use of these and other superalloy stainless steels provides a significant cost savings over the valve metals coated with precious metals or precious metal oxides, and they are equally effective. As expected, lower levels of alloys such as 304 or 316 stainless steel pitted and corroded.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

I claim:

1. An impressed current anode consisting essentially of a high alloy stainless steel material and a performance enhancing coating, the high alloy stainless steel material including about 45–70% iron.

2. An impressed current anode as set forth in claim 1 wherein the high alloy stainless steel material comprises at least 20% chromium.

3. An impressed current anode as set forth in claim 1 wherein the high alloy stainless steel material comprises at least 10% nickel.

4. An impressed current anode as set forth in claim 3 wherein the high alloy stainless steel material comprises at least 5% molybdenum.

5. An impressed current anode as set forth in claim 1 wherein the high alloy stainless steel material is a substrate on which a performance enhancing coating is applied to form an impressed current anode material.

6. An impressed current anode as set forth in claim 5, wherein the performance enhancing coating is an electrocatalytic coating.

7. An impressed current anode as set forth in claim 6, wherein the electrocatalytic coating is a precious metal or precious metal oxide.

8. An impressed current anode as set forth in claim 6, wherein the electrocatalytic coating is a conductive ceramic coating.

9. An impressed current anode as set forth in claim 1, wherein the anode is of a mesh configuration.

10. An impressed current anode as set forth in claim 1, wherein the anode is of a tubular configuration.

11. An impressed current anode, consisting essentially of a high alloy stainless steel, wherein the high alloy stainless steel includes about 45–70% iron, less than 0.1% carbon, at least 10% nickel and at least 20% chromium.

12. An impressed current anode as set forth in claim 11 wherein the iron is present in a range of about 45–70% iron.

13. An impressed current anode, consisting essentially of a high alloy stainless steel, wherein the high alloy stainless steel includes about 45–70% iron, less than 0.1% carbon, at least 20% chromium and at least 5% molybdenum.

14. An impressed current anode as set forth in claim 13 wherein the iron is present in a range of about 45–70% iron.

15. An impressed current anode, consisting essentially of a high alloy stainless steel, wherein the high alloy stainless steel includes about 45–70% iron, less than 0.1% carbon, at least 20% nickel and at least 5% molybdenum.

16. An impressed current anode consisting essentially of a high alloy stainless steel, the stainless steel having about 45–70% iron and less than 0.1% carbon, at least 20% chromium, at least 20% nickel and at least 5% molybdenum.

17. An impressed current anode as set forth in claim 16 wherein the iron is present in a range of about 45–55% iron.

18. An impressed current anode for cathodic protection consisting essentially of a high alloy stainless steel material wherein the stainless steel includes 45–70% iron.

19. The impression current anode of claim 18 wherein the alloy material further includes at least 10% nickel.

20. The impression current anode of claim 18 wherein the alloy material further includes at least 20% chromium.

21. The impression current anode of claim 18 wherein the alloy material further includes at least 5% molybdenum.

22. The impression current anode of claim 18 wherein the alloy material includes about 45–65% iron.

23. An impressed current anode as set forth in claim 1 wherein the iron based alloy material includes about 45–70% iron.

24. An impressed current cathodic protection electrode for use in underwater and/or underground applications to protect against oxidation, the electrode comprised substantially entirely of a high alloy stainless steel including 45–70% iron, trace amounts of carbon, and at least about 5% molybdenum and the electrode being substantially carbon free, except for the trace carbon present in the stainless steel, and resistant to corrosion and pitting.

25. An impressed current cathodic protection electrode as set forth in claim 24 wherein the performance enhancing coating is a precious metal or precious metal oxide.

26. An impressed current cathodic protection electrode as set forth in claim 24 wherein the performance enhancing coating is a conductive ceramic coating.

27. An impressed current cathodic protection electrode comprised substantially of a high alloy stainless steel including 45–70% iron, less than 0.1% carbon, and at least about 5% molybdenum, the stainless steel providing a substrate for a performance enhancing coating wherein the combination of the substrate and the performance enhancing coating forms substantially the entirety of the impressed current cathodic protection electrode material.

28. An impressed current cathodic protection electrode for use in underwater and/or underground applications to protect against oxidation, the electrode comprised substantially entirely of a high alloy stainless steel including chromium, nickel, molybdenum, nitrogen, and iron, the electrode being substantially devoid of free carbon and further being resistant to corrosion and pitting.

29. An impressed current cathodic protection electrode as set forth in claim 28 further including less than 0.1% of carbon and trace amounts of copper and manganese.

30. An impressed current cathodic protection electrode, comprised substantially of a high alloy stainless steel comprising 45–70% iron, greater than 6% molybdenum, the electrode being resistant to corrosion and pitting.

31. An impressed current cathodic protection electrode for use in underwater and/or underground applications to protect against oxidation, the electrode comprised substantially entirely of a high alloy stainless steel including 45–70% iron, the electrode being substantially carbon free and resistant to corrosion and pitting.

* * * * *